US007984623B2

(12) United States Patent
Bae et al.

(10) Patent No.: US 7,984,623 B2
(45) Date of Patent: Jul. 26, 2011

(54) REFRIGERATOR FOR CONTROLLING COOL AIR SUPPLIED TO A REFRIGERATING CHAMBER INDEPENDENTLY OF COOL AIR SUPPLIED TO A FREEZING CHAMBER

(75) Inventors: Jun-Ho Bae, Seoul (KR); Soo-Kwan Lee, Seoul (KR); Chang-Joon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 337 days.

(21) Appl. No.: 11/619,461

(22) Filed: Jan. 3, 2007

(65) Prior Publication Data

US 2007/0266727 A1 Nov. 22, 2007

(30) Foreign Application Priority Data

May 19, 2006 (KR) ..... 10-2006-0045313

(51) Int. Cl.
*F25D 17/06* (2006.01)

(52) U.S. Cl. ..... 62/419; 62/407; 62/441; 454/193

(58) Field of Classification Search ..... 62/419, 62/441, 407; 454/193
See application file for complete search history.

(56) References Cited

U.S. PATENT DOCUMENTS

| | | | | |
|---|---|---|---|---|
| 6,055,826 | A * | 5/2000 | Hiraoka et al. | 62/408 |
| 6,170,275 | B1 * | 1/2001 | Ueno et al. | 62/186 |
| 6,584,799 | B2 * | 7/2003 | Jung et al. | 62/419 |
| 6,837,067 | B2 | 1/2005 | Lee | |
| 6,865,899 | B2 | 3/2005 | Nam et al. | |
| 6,997,682 | B2 | 2/2006 | Jung et al. | |
| 7,134,292 | B2 | 11/2006 | Oh | |
| 2003/0167787 | A1 * | 9/2003 | Ohashi et al. | 62/443 |
| 2004/0237544 | A1 * | 12/2004 | Ueno et al. | 62/78 |
| 2005/0126207 | A1 * | 6/2005 | Lee et al. | 62/408 |
| 2005/0152781 | A1 * | 7/2005 | Baek et al. | 415/206 |
| 2005/0217307 | A1 | 10/2005 | Kim et al. | |
| 2005/0232765 | A1 * | 10/2005 | Watanabe et al. | 415/220 |
| 2007/0266718 | A1 * | 11/2007 | Lee et al. | 62/187 |

FOREIGN PATENT DOCUMENTS

| | | |
|---|---|---|
| JP | 07-127961 | 5/1995 |
| JP | 2000-105052 | 4/2000 |
| JP | 2002-098464 A | 4/2002 |
| JP | 2002-161895 A | 6/2002 |
| JP | 2003-240408 | 8/2003 |

(Continued)

OTHER PUBLICATIONS

English language Abstract of JP 2002-098464 A.

(Continued)

*Primary Examiner* — Cheryl J Tyler
*Assistant Examiner* — Justin Loffredo
(74) *Attorney, Agent, or Firm* — Ked & Associates LLP

(57) ABSTRACT

A refrigerator is provided including a freezing chamber having a first evaporator and a first fan provided inside, and a refrigerating chamber having a second evaporator and a second fan provided inside. Further, the first and second fans may be configured to direct cool air generated by the first and second evaporators to the freezing and refrigerating chambers, respectively. Additionally, plurality of cool-air ducts may be provided in at least one of the freezing and refrigerating chambers, the cool air ducts may be configured to provide cool air to the freezing and refrigerating chambers via operation of the first and second fans, respectively.

16 Claims, 7 Drawing Sheets

FOREIGN PATENT DOCUMENTS

| | | |
|---|---|---|
| JP | 2004-069247 | 3/2004 |

OTHER PUBLICATIONS

English language Abstract of JP 2002-161895 A.
Japanese Office Action dated Jun. 23, 2009.
Japanese Office Action issued in JP Application No. 2007-009293 dated Jun. 28, 2010.
English language Abstract of JP 2002-098464 A, Apr. 5, 2002.
English language Abstract of JP 2002-161895 A, Jun. 7, 2002.
Japanese Office Action dated Apr. 5, 2011.

* cited by examiner

REFRIGERATOR FOR CONTROLLING COOL AIR SUPPLIED TO A REFRIGERATING CHAMBER INDEPENDENTLY OF COOL AIR SUPPLIED TO A FREEZING CHAMBER

RELATED APPLICATION

The present disclosure relates to subject matter contained in priority Korean Application No. 10-2006-0045313, filed on May 19, 2006, which is herein expressly incorporated by reference in its entirety.

BACKGROUND OF THE INVENTION

1. Field of the Invention

The present invention relates to a refrigerator, and more particularly, to a refrigerator which is capable of controlling an amount of cool air supplied to a refrigerating chamber independently of a freezing chamber.

2. Description of the Background Art

Generally, a refrigerator is provided with an inner space including a refrigerating chamber and a freezing chamber partitioned by an partition wall. In this case, the freezing chamber is maintained at a low temperature so as to keep stored goods such as food in the frozen state. Also, the refrigerating chamber keeps food fresh, but the food is not maintained in the frozen state.

Hereinafter, a related art refrigerator will be described with reference to FIG. 1.

FIG. 1 is a frontal cross section view of illustrating a flow of cool air in a related art refrigerator.

As shown in FIG. 1, a related art refrigerator 10 is provided with a freezing chamber 20 and a refrigerating chamber 30 which are divided by an partition wall 40. Also, a cool-air inlet 24 is provided at a lower portion of the freezing chamber 20. In this case, stored food is cooled as cool air circulates in the freezing and refrigerating chambers 20 and 30. By cooling the stored food, the temperature of the cool air increases. Then, the cool air of the increased temperature is drawn through the cool-air inlet 24.

Also, an evaporator 23 is provided above the cool-air inlet 24, wherein the evaporator 23 exchanges heat with the cool air having the increased temperature after cooling the food. Additionally, a fan 22 is provided above the evaporator 23. The fan 22 sends the cool air passed through the evaporator 23 to the freezing and refrigerating chambers 20 and 30, wherein the cool air has a lowered temperature as it passes through the evaporator 23.

As the fan 22 is operated, the cool air is supplied to the freezing and refrigerating chambers 20 and 30 through a cool-air duct 21. Further, to guide the cool air toward the cool-air duct 21 of the freezing chamber 20, there is provided a guide (not shown). Also, the fan 22 is provided inside the guide.

Additionally, the evaporator 23 and the fan 22 are provided in the freezing chamber 20. The refrigerating chamber 30 has no additional evaporator and fan.

In the meantime, the cool-air duct 21 is provided above the fan 22, so that the cool air having the low temperature passed through the evaporator 23 is supplied to the inside of the freezing chamber 20. The cool-air duct 21 is provided with a plurality of cool-air outlets 21*a* to supply the cool air to the inside of the freezing chamber 20. At this time, the cool-air duct 21 may be formed as the singular number along a rear wall (not shown) of the freezing chamber 20.

Also, another cool-air duct 31 is provided in the refrigerating chamber 30. Further, the cool-air duct 31 of the refrigerating chamber 30 is provided in communication with the cool-air duct 21 of the freezing chamber 20. Even further, the cool-air duct 31 is provided as the singular number along a rear wall (not shown) of the refrigerating chamber 30. The cool-air duct 31 of the refrigerating chamber 30 is provided with a plurality of cool-air outlets 31*a* to supply the cool air to the inside of the refrigerating chamber 30.

The process of supplying the cool air to the freezing chamber 20 and the refrigerating chamber 30 in the above-mentioned refrigerator 10 will be explained as follows.

During operation of the refrigerator 10 having the above-mentioned structure, a compressor (not shown) is operated so that the evaporator 23 becomes cool. After the food stored in the refrigerator 10 is cooled by the generated cool air, the temperature of cool air is increased. Thus, the evaporator 23 makes the heat exchange with the cool air of the increased temperature, so that the temperature of cool air is lowered. According as the fan 22 is operated by a motor (not shown), the cool air of the low temperature circulates in the inside of the freezing chamber 20.

That is, after the cool air of the increased temperature is drawn through the cool-air inlet 24 formed in the lower portion of the evaporator 23, the temperature of cool air is lowered due to the heat exchange of the evaporator 23 as the cool air passes through the evaporator 23. Then, the cool air of the low temperature is drawn to the fan 22 through an orifice (not shown), and most of the cool air is supplied to the freezing chamber 20 through the cool-air duct 21 and the cool-air outlet 21*a* provided in the freezing chamber 20.

Meanwhile, some of the cool air is drawn to the cool-air duct 31 of the refrigerating chamber 30 through a cool-air pipeline (not shown), and is then supplied to the refrigerating chamber 30 through the cool-air outlet 31*a*.

Therefore, when repeating the above-mentioned flow of cool air, the inner space of the freezing chamber 20 and the refrigerating chamber 30 becomes cool.

However, the related art refrigerator 10 has the following disadvantages.

In the related art refrigerator 10, the evaporator 23 and the fan 22 are provided only in the freezing chamber 20. However, the additional evaporator and fan are not formed in the refrigerating chamber 30. Thus, it is impossible to control the amount of cool air supplied to the refrigerating chamber 30 independently of the freezing chamber 20.

In the meantime, it is impossible to separately perform the cooling function of the freezing chamber 20 and the refrigerating chamber 30. That is, some of cool air supplied to the freezing chamber 20 is supplied to the refrigerating chamber 30, whereby an odor of the freezing chamber 20 is mixed with an odor of the refrigerating chamber 30. That is, the odor of food stored in the freezing chamber 20 is mixed together with the odor of food stored in the refrigerating chamber 30.

Also, some of the cool air generated from the evaporator 23 is supplied to the freezing chamber 20 by the fan 22, and the remaining is then supplied to the refrigerating chamber 30. As a result, the amount of cool air supplied to the refrigerating chamber 30 is smaller than the amount of cool air supplied to the freezing chamber 20, so that a cooling speed of the refrigerating chamber 30 becomes slow. That is, a temperature variation increases in the refrigerator 10.

Even though the temperature of any one of the freezing chamber 20 and the refrigerating chamber 30 reaches a preset value, the compressors and the fans for the freezing and refrigerating chambers 20 and 30 are operated together until both the freezing and refrigerating chambers are maintained in the preset value, thereby causing the waste of power consumption.

Furthermore, the cool-air ducts 21 and 31 are respectively provided in the freezing and refrigerating chambers 20 and 30. Thus, it is impossible to vary the cool-air outlets 21*a* and 31*a* of the cool-air ducts 21 and 31 in number and size, and to provide a plurality of cooling chambers for a special purpose.

SUMMARY OF THE INVENTION

Therefore, an object of the present invention is to provide a refrigerator which is capable of controlling an amount of cool air supplied to a refrigerating chamber independently of a freezing chamber.

Also, another object of the present invention is to provide a refrigerator which can decrease a power consumption by separately controlling an amount of cool air supplied to a freezing chamber and a refrigerating chamber.

Another object of the present invention is to provide a refrigerator which can decrease a temperature variation by preventing a cooling speed of a freezing chamber from being slow.

A further object of the present invention is to provide a refrigerator which can vary a cool-air outlet in number and size.

To achieve these and other advantages and in accordance with the purpose of the present invention, as embodied and broadly described herein, there is provided a refrigerator comprising evaporators respectively provided in freezing and refrigerating chambers, fans respectively provided in the freezing and refrigerating chambers so as to send a cool air generated from the evaporators to the respective freezing and refrigerating chambers; and a plurality of cool-air ducts provided in at least one of the freezing and refrigerating chambers such that cool air is supplied to the freezing and refrigerating chambers by operating the fans.

In the refrigerator according to the present invention, the evaporator and the fan may be provided, respectively, for the freezing and refrigerating chambers. Thus, it is possible to control the amount of cool air supplied to the refrigerating chamber independently of the cool air supplied to the freezing chamber. Also, it is possible to increase the amount of cool air supplied to the inside of the refrigerating chamber, and to separately provide the cool air to the freezing chamber and the refrigerating chamber, thereby decreasing the temperature variation in the refrigerator.

Additionally, the refrigerator may also include a guide which accommodates (or receives) a respective one of the fans (i.e., one of the fans provided in the freezing and refrigerating chambers) and has a plurality of guide pipelines that communicate with the plurality of cool-air ducts. Additionally, the fan may be provided inside the guide. Accordingly, the cool air may be smoothly supplied to the plurality of cool-air ducts, thereby minimizing the loss of cool air in the flow, and improving the efficiency of the fan.

Meanwhile, the fan may be formed as one body (i.e., integral) with a motor. Further, when the motor is inserted into a hub of the fan, and the motor is formed as one body with the fan, the motor may be formed as an outer rotor-type motor. Thus, it should be appreciated that by using an outer rotor-type motor, it is possible to decrease a space between the motor and the fan, thereby increasing the useful space of the refrigerator.

Further, the fan may be provided as a turbofan. Thus, it should be appreciated that by utilizing a turbofan it may be possible to improve a compression ratio of the fan and uniformly supply the cool air to the plurality of cool-air ducts.

In the case where a turbofan is employed, the flow of cool air may be generated by a cool-air duct inlet and an orifice inlet of a shroud, which receives a respective turbofan, without an additional guide. Therefore, it is possible to decrease the fabrication cost of the refrigerator.

Additionally, the cool-air duct may be formed along at least one of sidewalls of the freezing chamber or the refrigerating chamber. In particular, the plurality of cool-air ducts may be formed along a corner formed by the sidewall of the freezing chamber and a rear wall of the freezing chamber. Accordingly, the cool air may be uniformly supplied to the freezing and refrigerating chambers such that it is possible to improve the efficiency of refrigerator. That is, when the number of cool-air ducts increases, it is possible to vary the cool-air outlets in number and size. However, it should be appreciated that any suitable arrangement of the cool-air ducts, which uniformly supplies air to the freezing and refrigerating chambers, may be employed.

Also, the cool-air duct may be formed along the rear wall as well as the sidewall of the freezing and refrigerating chambers. That is, since the number of cool-air ducts increases, it is possible to vary the cool-air outlet in number and size. Also, a plurality of cooling chambers for a special purpose (e.g., providing more efficient cooling) may be provided.

In another aspect of the present invention, a refrigerator may include evaporators (e.g., first and second evaporators) respectively provided in freezing and refrigerating chamber; turbofans (e.g., first and second turbofans) respectively provided above the evaporators so as to send (or direct) a cool air to the freezing and refrigerating chambers; an outer rotor-type motor provided in a hub of a respective turbofan so as to drive the turbofan; a shroud which accommodates (or receives) the turbofan, and has an orifice to send (or direct) the cool air to the turbofan; and a plurality of cool-air ducts provided in the respective freezing and refrigerating chambers in connection (e.g., communicating with or coupled to) with the shroud, wherein the cool-air ducts are provided with a plurality of cool-air outlets to discharge the cool air to the freezing and refrigerating chambers.

In another aspect of the present invention, a refrigerator comprises evaporators respectively provided in freezing and refrigerating chamber; centrifugal fans respectively provided above the evaporators so as to send (or direct) a cool air to the freezing and refrigerating chambers; a motor to drive the centrifugal fans; a guide which accommodates (or receives) the centrifugal fans, and has a plurality of guide pipelines with a predetermined curvature (i.e., a curvature configured to efficiently direct the flow the cool air); and a plurality of cool-air ducts provided in the respective freezing and refrigerating chambers in connection with the guide pipelines, wherein the cool-air ducts are provided with a plurality of cool-air outlets to discharge the cool air to the freezing and refrigerating chambers.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail to the preferred embodiments of the present invention, examples of which are illustrated in the accompanying drawings.

Hereinafter, a refrigerator according to the present invention will be explained with reference to the accompanying drawings.

Figure 1:
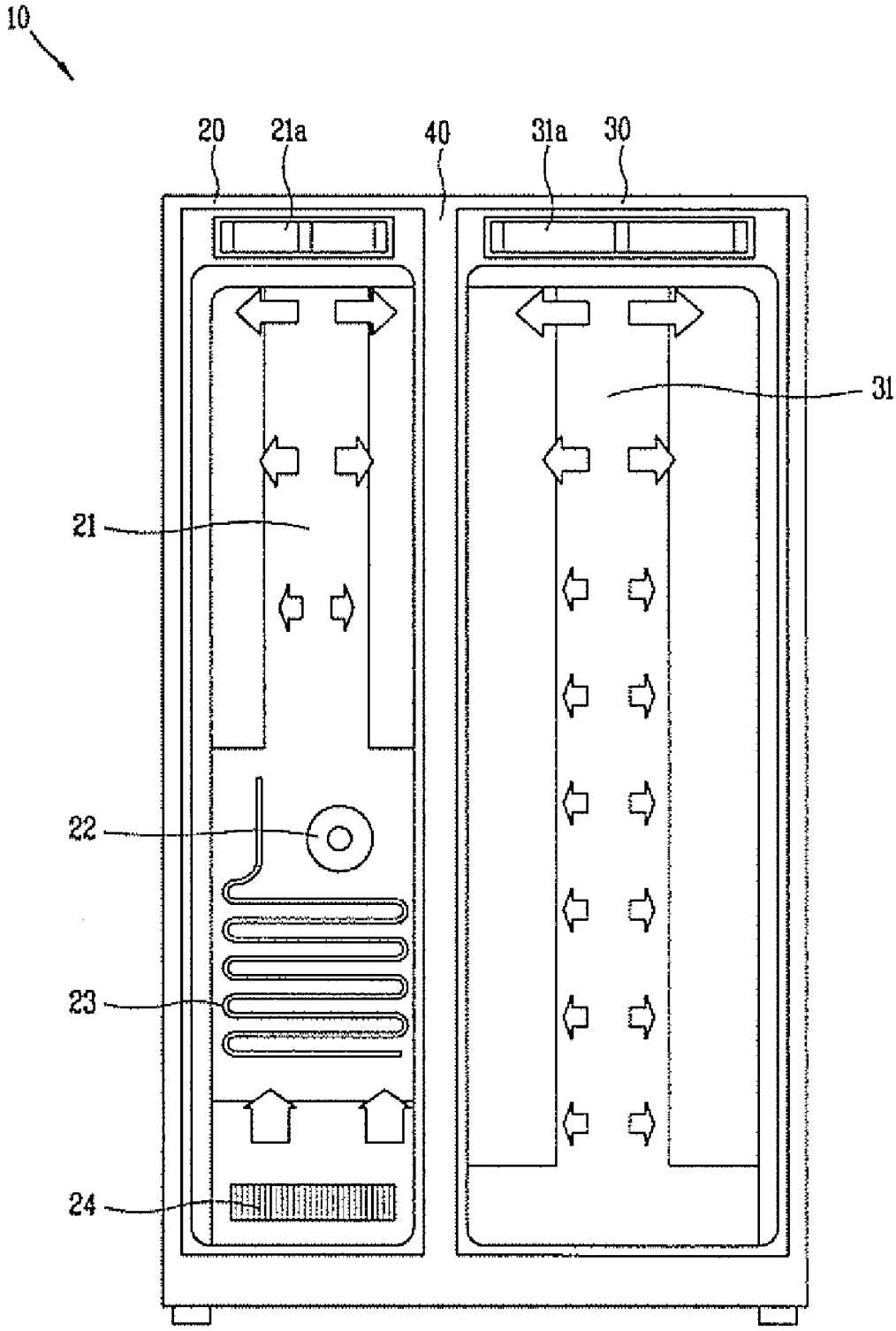
FIG. 1 CONVENTIONAL ART
FIG. 1 is a frontal cross section view of illustrating a flow of cool air in a related art refrigerator.
Figure 2:
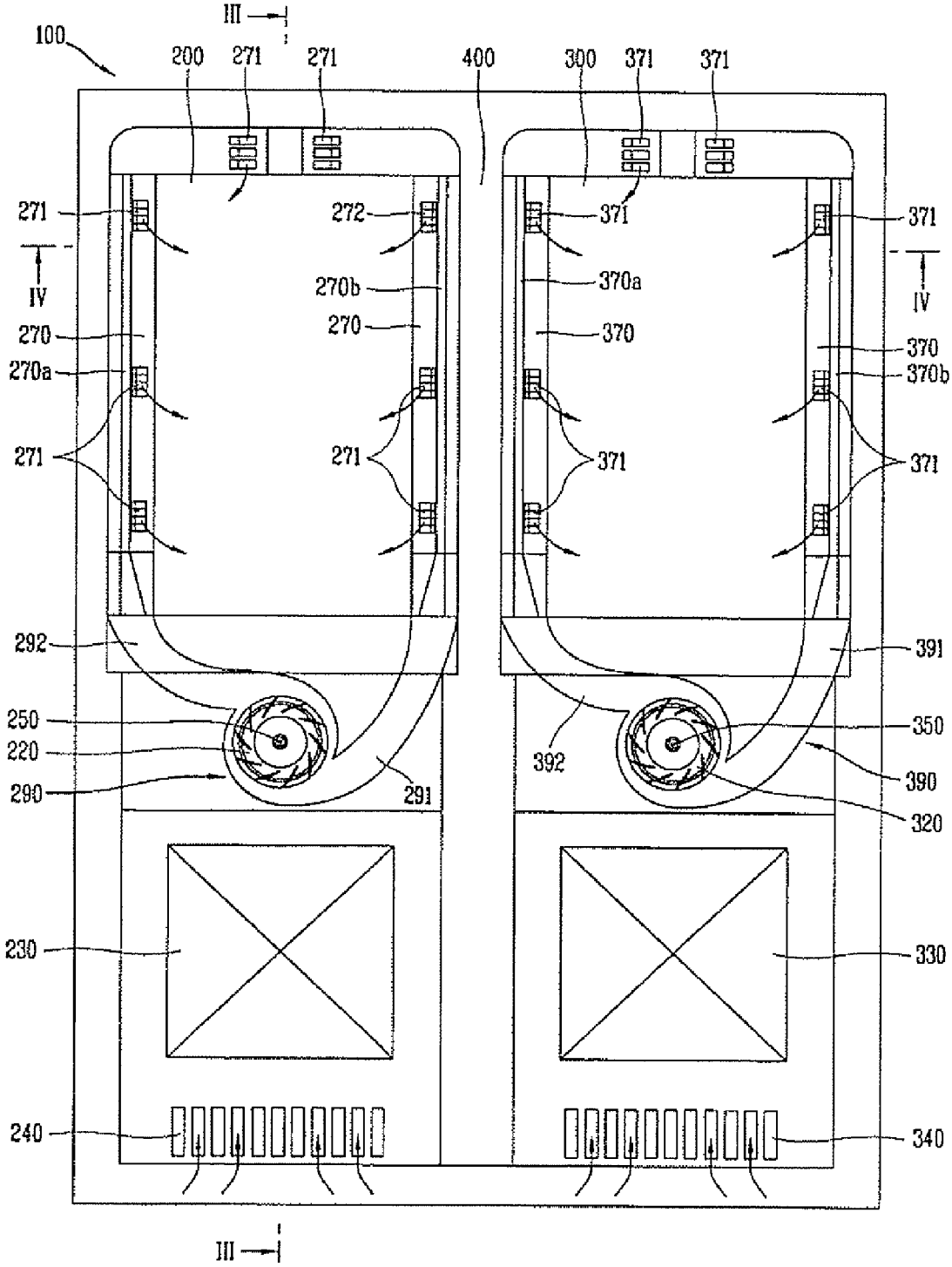
FIG. 2 is a cross section view of illustrating a flow of cool air in a refrigerator according to the first embodiment of the present invention.
Figure 3A:
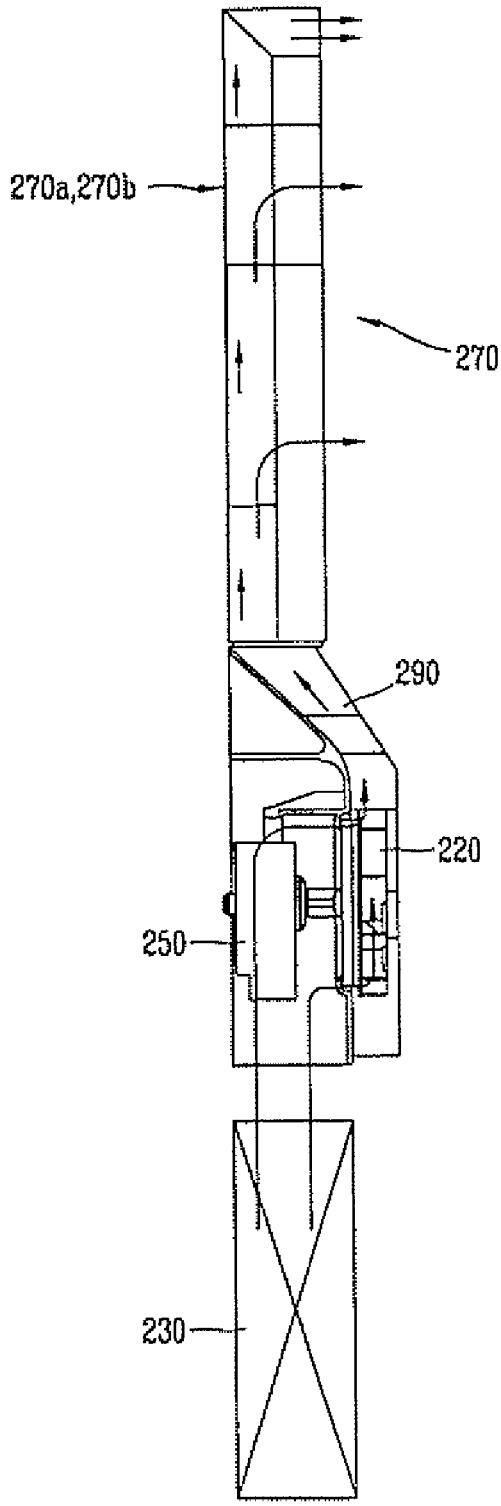
FIG. 3A is a lateral cross section view along III-III of FIG. 2.
Figure 3B:
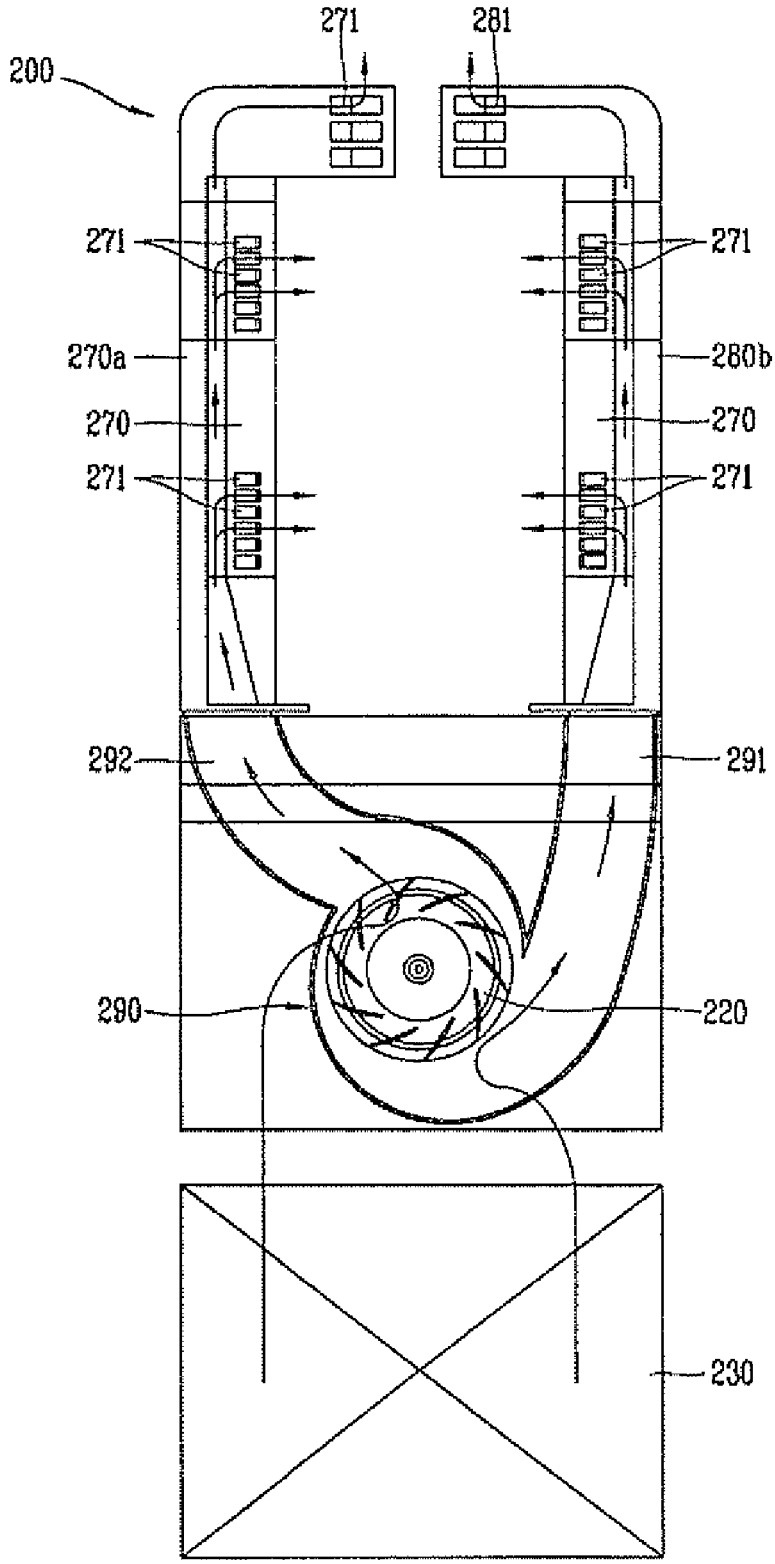
FIG. 3B is a frontal cross section view illustrating a flow of cool air in a refrigerator of FIG. 3A.
Figure 4:
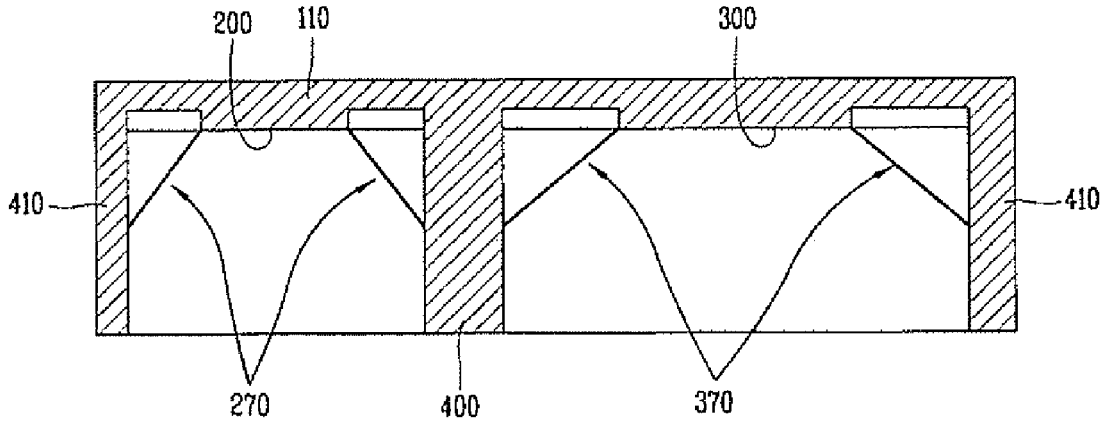
FIG. 4 is a cross section view along IV-IV of FIG. 2.
Figure 5:
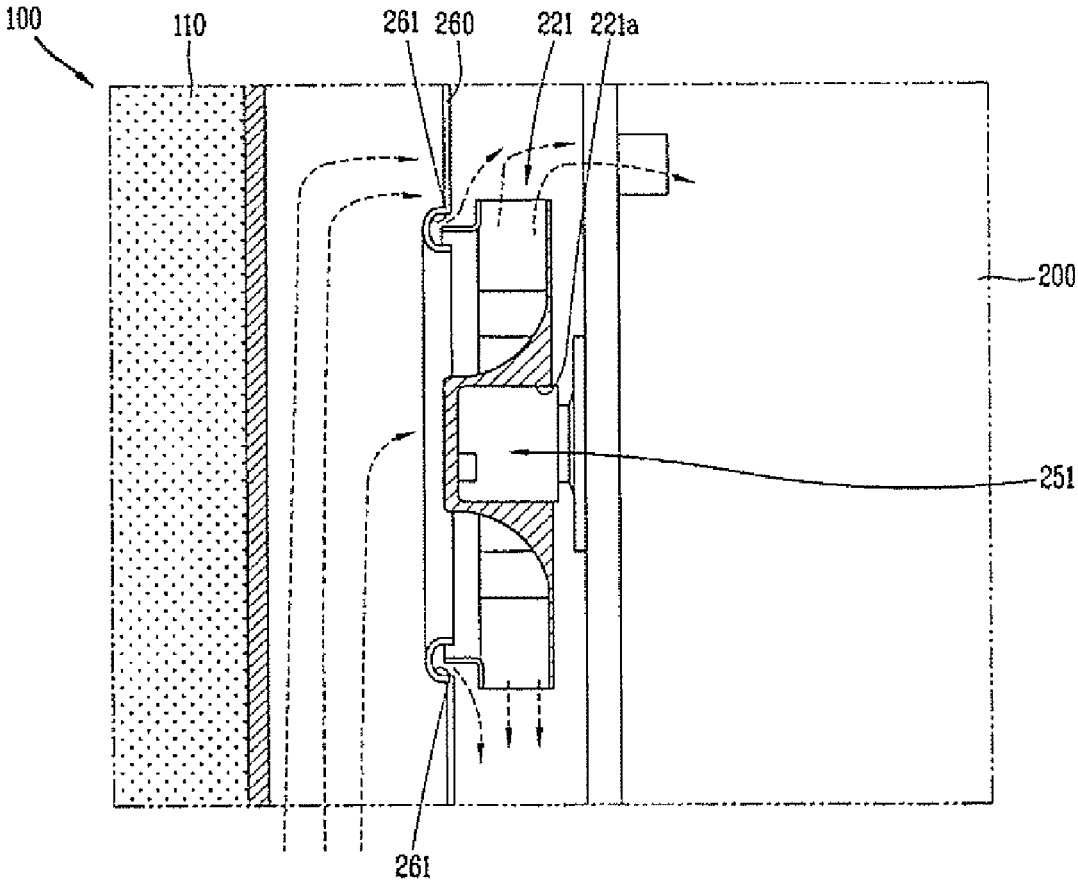
FIG. 5 is a cross section view illustrating a turbofan adopting an outer rotor type motor according to the first embodiment of the present invention.
Figure 6:
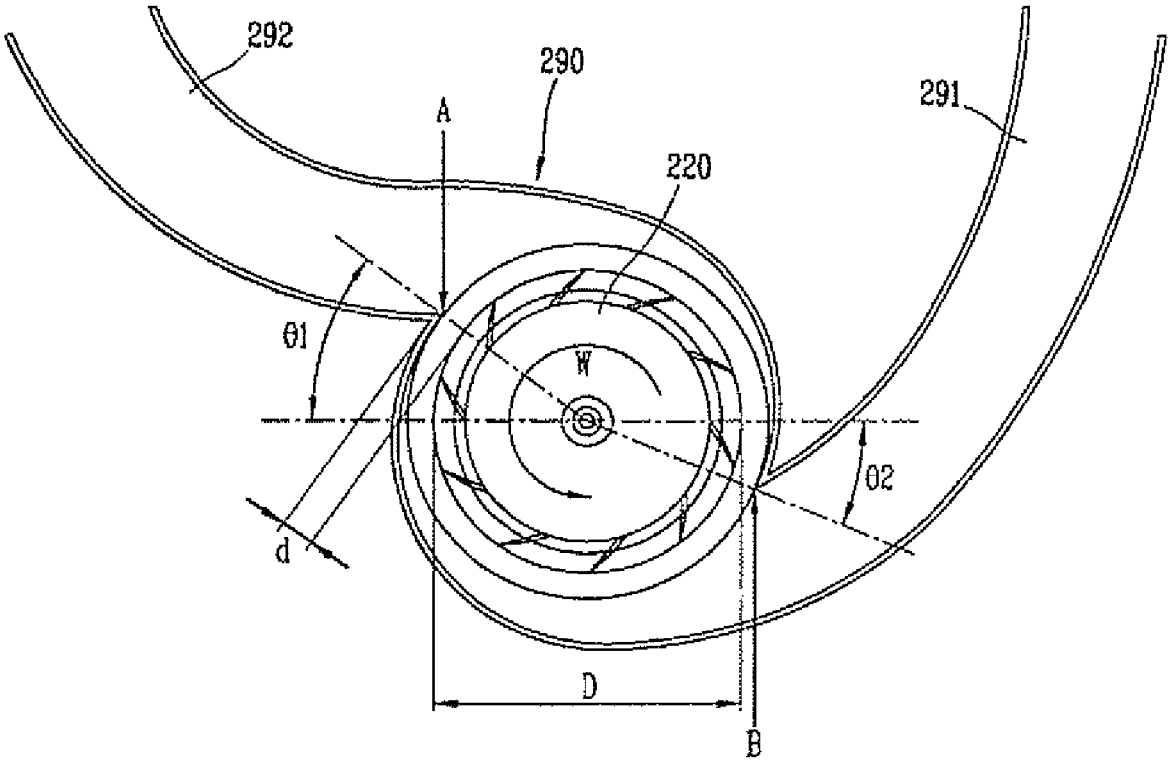
FIG. 6 is a cross section view illustrating a guide of a refrigerator according to the first embodiment of the present invention.
Figure 7:
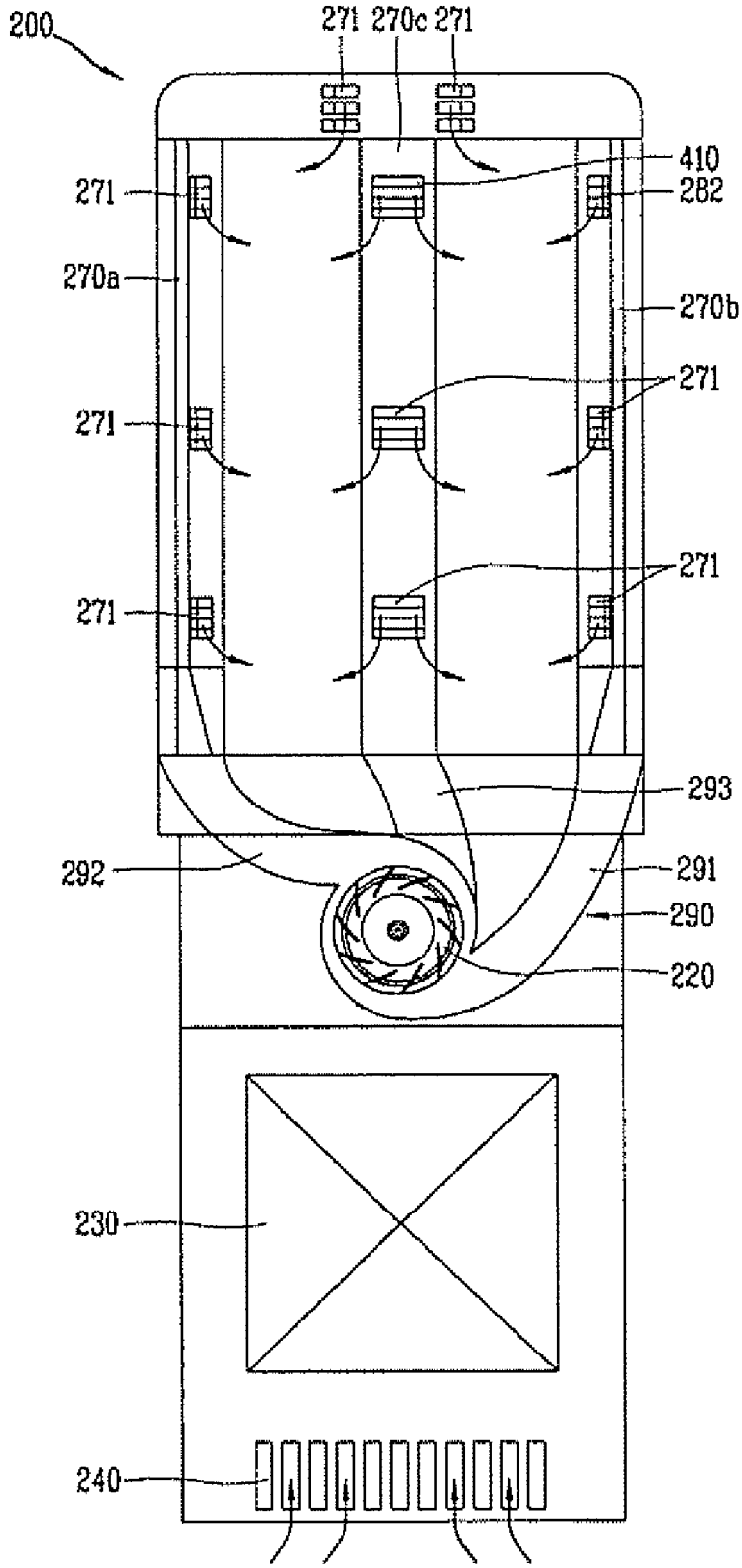
FIG. 7 is a cross section view illustrating a flow of cool air in a freezing chamber of a refrigerator according to the second embodiment of the present invention.

FIG. 2 is a cross sectional view illustrating a flow of cool air in a refrigerator according to a first embodiment of the present invention. FIG. 3A is a lateral cross sectional view along line III-III of FIG. 2. FIG. 3B is a frontal cross sectional view illustrating a flow of cool air in a refrigerator of FIG. 3A. FIG. 4 is a cross sectional view along line IV-IV of FIG. 2. FIG. 5 is a cross sectional view illustrating a turbofan that includes an outer rotor type motor according to the first embodiment of the present invention, FIG. 6 is a cross sectional view illustrating a guide of a refrigerator according to the first embodiment of the present invention. FIG. 7 is a cross sectional view illustrating a flow of cool air in a freezing chamber of a refrigerator according to the second embodiment of the present invention.

Referring to FIGS. 2 and 3, a refrigerator 100 according to the first embodiment of the present invention may be provided with freezing and refrigerating chambers 200 and 300, respectively, divided by a partition wall 400; evaporators (e.g., first and second evaporators) 230 and 330, respectively, formed in the freezing and refrigerating chambers 200 and 300 to generate a cool air; fans (e.g., first and second fans) 220 and 320, respectively, formed in the freezing and refrigerating chambers 200 and 300 and configured to send (or direct) the cool air generated from the evaporators 230 and 330 to the freezing and refrigerating chambers 200 and 300; guides 290 and 390 to accommodate (or receive) the respective fans 220 and 320 therein; motors (e.g., first and second motors) 250 and 350 to drive the respective fans 220 and 320; a first cool-air duct 270 for the freezing chamber 200 to supply the cool air to the freezing chamber 200; and a second cool-air duct 370 for the refrigerating chamber 300 to supply the cool air to the refrigerating chamber 300.

However, it should be appreciated that the number of freezing and refrigerating chambers (200 and 300, respectively) is not limited to one. For example, the plurality of freezing and refrigerating chambers 200 and 300 may be provided according to a particular occasion (or task to be accomplished). However, in the present case, for exemplary purposes the evaporators are provided based on the number of the freezing and refrigerating chambers (200 and 300, respectively).

The flow of cool air in the freezing chamber 200 may be identical to the flow of cool air in the refrigerating chamber 300. For convenience of explanation, the flow of cool air in the freezing chamber 200 will be explained in detail.

The fan 220 may be provided above the evaporator 230 or at the upper side of the passage direction of the cool air. However, it should be appreciated that the location of the fan is not limited to the aforementioned locations. After the cool air circulates in the freezing chamber 200 so as to cool the food stored therein, the cool air increases in temperature. Then, the evaporator 230 exchanges heat with the cool air having increased temperature, and drawn through the cool-air inlet 240. Therefore, the temperature of cool air is lowered. Then, the cool air having the lowered temperature is sent (or directed) to the freezing chamber 200 by the fan 220. In this case, the motor 250 of the driving the fan 220 may be provided at one side of the fan 220. However, it should be appreciates that the motor 250 may be provided at any suitable location, or having any suitable arrangement.

The fan 220 may be formed (or provided) as a centrifugal fan having a plurality of blades. Also, the fan 220 may be provided inside the guide 290 which guides (or is configured to guide) the cool air ventilated by the fan 220 to the cool-air duct 270. Further, the guide 290 may be formed (or provided) in communication with the cool-air duct 270 which supplies the cool air to the freezing chamber 200.

As shown in FIG. 5, the fan 220 may be formed as a turbofan 221 instead of a centrifugal fan. When the fan 220 is a turbofan 221, it is possible to generate more cool air, and to improve a compression ratio of the system (i.e., the freezing and refrigerating chambers), thereby improving the efficiency of the fan.

Also, when utilizing a turbofan 221, the flow of cool air can be generated without the guide 290. That is, the flow of cool air may be generated with an inlet of the cool-air duct 270 and an inlet of an orifice 261 formed in a shroud 260 which accommodates (or receives) the turbofan 221 therein. Further, due to the orifice 261, the cool air may be correctly (e.g., efficiently) drawn to the fan 221.

Based on the above-mentioned structure, when providing the inlet of the orifice 261 which may correspond to the cool air inlet and a cool-air outlet 271 of the cool-air duct 270, the cool air is supplied to the cool-air duct 270 without using the guide 290 to guide the cool air ventilated by the fan 221.

For example, when utilizing the turbofan 221, one end of the shroud 260 may be connected (e.g., communicating or coupled) with the cool-air duct 270.

Also, the motor 251 may be inserted into the inside of a hub 221*a* of the turbofan 221 such that the turbofan 221 is formed as one body (or integral) with the motor 251. Accordingly, the useful space of the freezing chamber 200 and volume may be increased.

Further, when utilizing the motor 251 of the outer rotor-type, the rotor may be positioned outside a stator, a height of the outer rotor-type motor may be relatively lower than a height of an inner rotor-type motor. Thus, even though the motor 251 may be inserted into the hub 221*a* of the turbofan 221, the motor 251 doesn't occupy a large space therein. Therefore, it is possible to obtain (or provide) a relatively large volume. In FIG. 5, the arrow of dotted line corresponds to the flow of cool air.

As shown in FIG. 4, the plurality of cool-air ducts 270 may be provided along a sidewall 410 of the freezing chamber 200, or may be provided at a corner formed by the sidewall 400 and 410 of the freezing chamber 200 and a rear wall 110 of the freezing chamber 200.

The cool-air duct 270 may be provided with the plurality of cool-air outlets 271 to uniformly supply the cool air to the inside of the freezing chamber 200.

For example, the cool-air duct 270 may include, e.g., the duct 270*a* formed at the left sidewall 410 of the freezing chamber 200, and the duct 270*b* formed at the right sidewall 400 (or partition wall).

The guide 290 may be provided with a plurality of guide pipelines 291 and 292 may be formed in communication with the plurality of cool-air ducts 270.

The guide pipelines 291 and 292 are provided in communication with the plurality of cool-air ducts 270*a* and 270*b* such that it is possible to prevent the cool air from being wasted in the flow, and to decrease the power consumption, thereby improving the efficiency of the fan.

As shown in FIG. 6, the guide 290 may be constructed such that the cool air may be sent (or directed) from one side to the other side of the fan 220 by operating the fan 220, whereby the cool air is transmitted to the cool-air ducts 270*a* and 270*b*.

In this case, the guide 290 may be provided with a first guide pipeline 291 and a second guide pipeline 292. The first guide pipeline 291 may extend having a predetermined curvature (e.g., a curvature configured to efficiently direct the flow the cool air) toward a rotation direction of the fan 220 from a first starting point (A) positioned at a predetermined angle (i.e., an angle configured to allow efficient flow of the cool air) on one side of a horizontal line which passes through a rotation center of the fan 220. Further, the first guide pipeline 291 may be formed in communication with the cool-air duct 270*b* formed along the right sidewall 400 of the freezing chamber 200. Also, the second guide pipeline 292 is extend having a predetermined curvature toward the rotation direction of the fan 220 from a second starting point (B) positioned at a predetermined angle on the other side of the horizontal line passed through the rotation center of the fan 220. Similar to the first guide pipelines 221, the second guide pipeline 292 may be formed in communication with the cool-air duct 270*a* formed along the left sidewall 410 of the freezing chamber 200.

Each of the first guide pipeline 291 and the second guide pipeline 292 may be connected (or otherwise coupled) to one end of the cool-air ducts 270*a* and 270*b* formed along the left and right sidewalls of the freezing chamber 200 in order to supply the cool air to the cool-air duct 270*a* formed along the left sidewall 410 of the freezing chamber 200 and the cool-air duct 270*b* formed along the right sidewall 400 of the freezing chamber 200 by driving the fan 220. Further, the cool air has a lowered temperature, due to exchanging heat with the evaporator 230, after being drawn through the cool-air inlet 240 provided at the lower portion of the evaporator 230.

Further, it should be appreciated that it is possible to vary the cool-air outlets 271 of the cool-air ducts 270*a* and 270*b* in any number, position and size without departing from the objects of the present invention.

Further, each of the first and second guide pipelines 291 and 292, respectively, may have the predetermined curvature extending in a direction corresponding to the rotation direction of the fan 220. Therefore, the cool air may be guided smoothly through the first and second guide pipelines 291 and 292, respectively, by operating the fan 220. Additionally, the first and second guide pipelines 291 and 292 may be formed as one body (i.e., integral) with the guide 290.

Further, the first starting point (A) may be, e.g., positioned at an angle of about 45 to about 55 degrees in the opposite direction of a rotational direction of the fan 220 with respect to a horizontal line which passes through the rotational center of the fan 220. Also, the second starting point (B) may be positioned at an angle of about 15 to about 25 degrees in the opposite direction to the rotational direction of the fan 220 from the horizontal which passes through the rotational center of the fan 220.

Further, the first starting point (A) may be positioned opposite to the second starting point (B) on the horizontal line which passes through the rotational center of the fan 220. In other words, the first starting point (A) may be positioned above the horizontal line, and the second starting point (B) may be positioned below the horizontal line.

In FIG. 6, 'W' corresponds to the rotation direction of the fan 220; 'θ1' corresponds to the angle formed by the first starting point (A) and the horizontal line passed through the rotation center of the fan 220; 'θ2' corresponds to the angle formed by the second starting point (B) and the horizontal line passed through the rotation center of the fan 220; 'D' corresponds to the diameter of the fan 220; and 'd' corresponds to the minimum interval between the guide 290 and the fan 220.

Based on the angle of each starting point of the guide pipelines 291 and 292, the loss of cool air varies in the flow. In case of the great loss of cool air, it is necessary to provide more cool air, whereby the power consumption is increased to drive the fan more.

For example, the minimum interval (d) provided between the fan 220 and the guide 290 may be formed between 4% and 6% of the diameter (D) of the fan 220. In this regard, it should be appreciated that if the minimum interval (d) is too small, it may be difficult to ventilate the cool air smoothly, thereby resulting in an undesirable increase in power consumption. Meanwhile, if the minimum interval (d) is too large, it may be difficult to obtain the appropriate compression ratio.

As shown in FIG. 7, the refrigerator 100 according to the second embodiment of the present invention may include a cool-air duct 270*c* provided in the rear wall 110 of the freezing chamber 200.

Also, a third guide pipeline 293 may be formed in the guide 290. Further, the third guide pipeline 293 may be provided in communication with the cool-air duct 270*c* formed along the rear wall 110 of the freezing chamber 200. Accordingly, it is possible to vary a cool-air outlet 271 both in number and size.

Further, it should be appreciated that the cool-air duct 270 may be additionally provided at any suitable position as well as the left and right sidewalls 400 and 410 and the rear wall of the freezing chamber 200.

A function of the refrigerator according to a second embodiment of the present invention will be explained as follows.

If a power is supplied to the refrigerator by a user, the compressor (not shown) is operated so that the evaporator 230 becomes cool. Accordingly, as the cool air of the increased temperature is drawn to the evaporator 230 through the cool-air inlet 240 formed in the lower portion of the evaporator 230, the evaporator 230 makes the heat exchanged with the cool air of the increased temperature, whereby the temperature of cool air is lowered. Then, the cool air of the low temperature is drawn to the fan 220.

By operating the fan 220 connected (or coupled) to the motor 250, the cool air is passed through the fan 220, and is then drawn to the cool-air duct 270 through the guide pipelines 291 and 292 of the guide 290 formed outside of the fan 220.

At this time, the cool air which passes through the first guide pipeline 291 may be drawn to the cool-air duct 270*b* formed along the right sidewall 400 of the freezing chamber 200. Also, the cool air passed through the second guide pipeline 292 may be drawn to the cool-air duct 270*a* formed along the left sidewall 410 of the freezing chamber 200.

Also, the cool air passed through the third guide pipeline 293 may be drawn to the cool-air duct 270*c* formed along the rear wall 110 of the freezing chamber 200, wherein the third guide pipeline 293 may be provided in communication with the cool-air duct 270*c*.

The cool air drawn to the cool-air ducts 270*a*, 270*b* and 270*c* may be discharged through the plurality of cool-air outlets 271 formed in the respective cool-air ducts 270*a*, 270*b* and 270*c*. Accordingly, the cool air may be uniformly supplied to the inside of the freezing chamber 200 such that food stored in the freezing chamber 200 is maintained in the frozen state.

In the above explanation, it should be appreciated that the flow of cool air in the freezing chamber 200 is described exemplarily. Further, the refrigerating chamber 300 may have the same flow of cool air as that of the freezing chamber 200. However, the number of cool-air ducts provided in the freezing chamber 200 may be different from the number of cool-air ducts provided in the refrigerating chamber 300.

Also, the plurality of cool-air ducts may be provided in both the freezing chamber 200 and the refrigerating chamber 300, or may be provided in one of the freezing chamber 200 and the refrigerating chamber 300.

As mentioned above, the refrigerator according to the present invention has the following advantages.

In the refrigerator according to the present invention, the evaporator and the fan may be provided for (or in) each of the freezing and refrigerating chambers. Thus, it is possible to control the amount of cool air supplied to the refrigerating chamber independently of the freezing chamber, thereby obtaining the rapid cooling speed for the refrigerating chamber.

Also, the plurality of cool-air ducts may be provided in each of the freezing chamber and the refrigerating chamber, whereby the flow of cool air in the freezing chamber may be separate from the flow of cool air in the refrigerating chamber. Accordingly, it is possible to prevent the odor of food stored in the freezing chamber from being mixed with the odor of food stored in the refrigerating chamber.

Further, the fans are respectively provided in the freezing and refrigerating chambers. That is, if any one of the freezing and refrigerating chambers reaches a preset temperature, its fan are stopped so that the power consumption may be decreased.

Also, it is possible to increase the amount of cool air supplied to the inside of the refrigerating chamber, and to separately provide the cool air to the freezing chamber and the refrigerating chamber, thereby decreasing the temperature variation in the refrigerator.

Also, each of the freezing and refrigerating chambers may be provided having a plurality of cool-air ducts. Therefore, it is possible to vary the cool-air outlets in number and size. Thus, the refrigerator can be constructed such that the plurality of cooling boxes for the multi-purpose are provided.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A refrigerator comprising:

a freezing chamber having a first evaporator and a first fan provided therein;

a refrigerating chamber having a second evaporator and a second fan provided therein, wherein the first and second fans are configured to direct cool air generated by the first and second evaporators to the freezing and refrigerating chambers, respectively; and a plurality of cool-air ducts provided in at least one of the freezing or refrigerating chambers, the cool air ducts being configured to provide cool air to at least one of the freezing or refrigerating chambers via operation of the first and second fans, respectively, and wherein the refrigerator further comprises:

at least one guide which receives or is coupled to either one of the first or second fans, the at least one guide having a plurality of guide pipelines with first ends in communication with the plurality of cool-air ducts and second ends positioned around said one of the first or second fans, wherein the second ends are closer to said one of the first or second fans than the first ends along respective airflow paths through the guide pipelines, wherein the second ends of the guide pipelines are positioned on different sides of said one of the first or second fans in a spiral pattern, the second end of a first one of the guide pipelines positioned around said one of the first or second fans at a first angle and the second end of a second one of the guide pipelines positioned around said one of the first or second fans at a second angle different from the first angle, wherein the second end of the first one of the guide pipelines is coupled to the second end of the second one of the guide pipelines to form an enclosure around said one of the first or second fans, wherein the second ends of said first and second ones of the guide pipelines are positioned around said one of the first fan or the second fan at the first and second different angles relative to a reference line passing through a center of the fan, wherein the first angle is measured from the reference line to a first point which corresponds to first location where the second end of the first one of the guide pipelines contacts the second end of the second one of the guide pipelines, and wherein the second angle is measured from the reference line to a second point which corresponds to a second location where the second end of the first one of the guide pipelines contacts the second end of the second one of the guide pipelines.

2. The refrigerator according to claim 1, wherein at least one of the first or second fans is formed to be integral with an outer rotor-type motor configured to drive the integrally formed fan.

3. The refrigerator according to claim 2, wherein the integrally formed fan is a turbofan.

4. The refrigerator according to claim 3, further comprising:

a shroud which receives the turbofan; and an orifice provided in the shroud.

5. The refrigerator according to claim 4, wherein one end of the shroud is connected with one or more of the cool-air ducts.

6. The refrigerator according to claim 1, wherein either one of the first or second fans is formed as a centrifugal fan.

7. The refrigerator according to claim 1, wherein at least one of the plurality of cool-air ducts is provided along at least one sidewall of either the freezing or refrigerating chambers.

8. The refrigerator according to claim 1, wherein at least one of the plurality of cool-air ducts is provided along at least one corner formed by at least one sidewall and at least one rear wall of either one of the freezing or refrigerating chambers.

9. The refrigerator according to claim 7, further comprising at least another of the plurality of cool-air ducts formed along at least one rear wall of either one of the freezing chamber or the refrigerating chamber.

10. The refrigerator of claim 1, wherein at least one of the plurality of cool-air ducts is provided with a plurality of cool-air outlets to discharge cool air to either one of the freezing or refrigerating chambers, and wherein a number of cool-air ducts provided in the freezing chamber is different from a number of cool-air ducts provided in the refrigerating chamber.

11. The refrigerator of claim 1, wherein a spacing between at least one of the first point or the second point and blades of said one of the first fan or the second fan is between about 4% and 6% of a diameter of the fan.

12. The refrigerator of claim 1, wherein the first end of the first one of the guide pipelines is coupled to one or more cool-air outlets at a first side of a corresponding one of the refrigerator or freezing chambers, wherein the first end of the second one of the guide pipelines is coupled to one or more cool-air outlets at an opposing second side of a corresponding one of the refrigerator or freezing chambers, and wherein a third guide pipeline is coupled to one or more cool-air outlets located between the first and second sides of a corresponding one of the refrigerator or freezing chambers.

13. The refrigerator of claim 1, wherein:

the second end of the first one of the guide pipelines is coupled to the first and second points and spans a first angular range around said one of the first or second fans that is less than 180°, and the second end of the second one of the guide pipelines is coupled to the first and second points and spans a second angular range around said one of the first or second fans that is greater than 180°, the second ends of the first and second ones of the guide pipelines providing a 360° enclosure around said one of the first or second fans.

14. The refrigerator of claim 1, wherein the second end of the first one of the guide pipelines is coupled to the second end of the second one of the guide pipelines to form an enclosure which entirely surrounds said one of the first or second fans.

15. The refrigerator of claim 1, wherein a curved wall of the first one of the guide pipelines is arranged in opposing relation to a curved wall of the second one of the guide pipelines along an axis which passes through a center of said one of the first or second fans.

16. A refrigerator, comprising:

a freezing chamber having a first evaporator and a first fan provided therein;

a refrigerating chamber having a second evaporator and a second fan provided therein wherein the first and second fans are configured to direct cool air generated by the first and second evaporators to the freezing and refrigerating chambers, respectively; and a plurality of cool-air ducts provided in at least one of the freezing or refrigerating chambers, the cool air ducts being configured to provide cool air to at least one of the freezing or refrigerating chambers via operation of the first and second fans, respectively, and wherein the refrigerator further comprises:

at least one guide which receives or is coupled to either one of the first or second fans, the at least one guide having a plurality of guide pipelines with first ends in communication with the plurality of cool-air ducts and second ends positioned around said one of the first or second fans, wherein the second ends are closer to said one of the first or second fans than the first ends along respective airflow paths through the guide pipelines, wherein the second ends of the guide pipelines are positioned on different sides of said one of the first or second fans in a spiral pattern, the second end of a first one of the guide pipelines positioned around said one of the first or second fans at a first angle and the second end of a second one of the guide pipelines positioned around said one of the first or second fans at a second angle different from the first angle, wherein the second end of the first one of the guide pipelines is coupled to the second end of the second one of the guide pipelines to form an enclosure around said one of the first or second fans, and wherein the first and second ones of the guide pipelines are the only guide pipelines coupled to receive air flow from said one of the first or second fans.

* * * * *